US007218848B2

(12) United States Patent
Hinesley

(10) Patent No.: US 7,218,848 B2
(45) Date of Patent: May 15, 2007

(54) DIFFUSE-PATTERN RADIANT HEATER WITH NON-PARABOLIC REFLECTOR APPARATUS AND METHOD

(75) Inventor: Carl P. Hinesley, Pinehurst, NC (US)

(73) Assignee: Marley Engineered Products, LLC, Bennettsville, SC (US)

( * ) Notice: Subject to any disclaimer, the term of this patent is extended or adjusted under 35 U.S.C. 154(b) by 0 days.

(21) Appl. No.: 10/895,892

(22) Filed: Jul. 22, 2004

(65) Prior Publication Data

US 2006/0018640 A1 Jan. 26, 2006

(51) Int. Cl.
*F21V 7/00* (2006.01)

(52) U.S. Cl. ..... 392/420; 392/376; 219/480

(58) Field of Classification Search ..... 392/376, 392/365–369, 373–374, 420, 422–430; 219/480, 219/508

See application file for complete search history.

(56) References Cited

U.S. PATENT DOCUMENTS

| | | | | | |
|---|---|---|---|---|---|
| 1,393,368 | A | * | 10/1921 | Henry | 392/426 |
| 1,398,217 | A | * | 11/1921 | Brown et al. | 392/427 |
| 1,517,759 | A | * | 12/1924 | Shoenberg | 392/423 |
| 1,941,893 | A | * | 1/1934 | Guggenheim | 219/537 |
| 2,073,582 | A | * | 3/1937 | Morse | 392/427 |
| 2,234,373 | A | * | 3/1941 | Gough | 392/376 |
| 2,257,366 | A | * | 9/1941 | Bates et al. | 392/414 |
| 2,316,563 | A | * | 4/1943 | Wood | 392/376 |
| 2,410,211 | A | * | 10/1946 | Gough | 392/376 |
| 3,051,820 | A | * | 8/1962 | Krichton | 392/376 |
| 3,189,727 | A | * | 6/1965 | Jepson et al. | 392/376 |
| 4,007,365 | A | * | 2/1977 | Stempfle et al. | 362/283 |
| 5,072,665 | A | * | 12/1991 | Lababia Del Fresno | 99/391 |
| 6,385,396 | B1 | * | 5/2002 | Liu et al. | 392/423 |

FOREIGN PATENT DOCUMENTS

| | | | |
|---|---|---|---|
| AU | 128180 | * | 7/1948 |
| CA | 734602 | * | 5/1966 |
| DE | 820732 | * | 11/1951 |
| GB | 169454 | * | 11/1922 |
| GB | 349741 | * | 6/1931 |
| GB | 593095 | * | 7/1944 |
| GB | 743152 | * | 1/1956 |
| GB | 975009 | * | 11/1964 |
| GB | 1070206 | * | 6/1967 |

* cited by examiner

*Primary Examiner*—Thor Campbell
(74) *Attorney, Agent, or Firm*—Baker & Hostetler LLP

(57) ABSTRACT

A radiant heater includes a radiant heat source and a reflector to direct the bulk of the heat generated by the radiant source in one direction. The shape of the reflector determines the radiant pattern of the heater, and generally defocuses the output to provide a diffuse heat pattern that is substantially free of hot spots.

12 Claims, 5 Drawing Sheets

DIFFUSE-PATTERN RADIANT HEATER WITH NON-PARABOLIC REFLECTOR APPARATUS AND METHOD

FIELD OF THE INVENTION

The present invention relates generally to electric space heaters. More particularly, the present invention relates to controlling and defining the extent of focusing of infrared radiation from a space heater product.

BACKGROUND OF THE INVENTION

For a variety of reasons, a relatively small space such as a room may require heat. This heat may be in addition to that furnished from existing air treatment systems. One way to provide additional heat is with an electric portable heater. One type of such space heaters is a relatively small, sometimes floor-standing, heater that is configured to run on premises distribution circuits, that is, normal household and business wiring.

Heaters of various types may emit heat by radiation, convection, or conduction. A non-radiative electric heater may, for example, have one or more heating elements that release heat at comparatively low energy to raise the temperature of a quantity of air. Such heaters may then blow that heated air into a space using one or more fans or other circulation-promoting apparatus, so that a significant proportion of the heating performed by such heaters involves mixing heated air into ambient air, while direct radiation of heat may represent a secondary characteristic of such heaters.

Typical radiative electric heaters, by contrast, may release the majority of their heat in the form of infrared radiation emitted by one or more heating elements operated at comparatively high energy levels. Such heating elements typically combine infrared radiative heating of objects in the path of the radiation with a small amount of direct heating of the intervening air. Other heater types may combine these modes.

While some styles of heaters emit their heat from a front side only, the radiative heating elements within such front-radiating heaters typically radiate uniformly in all directions. As a consequence, it may be desirable to use an infrared reflector to redirect heating element radiation that would otherwise radiate upward, downward, or toward the rear of the heater so that as much of the heat as is practical may be directed out the front.

Radiative heaters may also have fans or other air circulation devices, which circulation devices may promote uniform heating of spaces in which the heaters are installed, may minimize temperature rise in the heater, and may improve the effectiveness of thermostat devices used as part of the heaters to maintain equilibrium temperature in a heated space.

In some instances, it may be desirable for a radiative heater to provide infrared heating that is focused in a general direction, such as generally in front of the heater, but diffused over a range in that direction to provide heat over a large area.

Accordingly, it is desirable to provide a radiative heater that can promote diffusion of heat through a broad region generally centered on the front of the heater.

SUMMARY OF THE INVENTION

The foregoing needs are met, to a great extent, by the present invention, wherein in one aspect an apparatus is provided that in some embodiments provides a radiative heater that can promote diffusion of heat through a broad region, which region may in some embodiments be substantially centered on the front of the heater.

In accordance with one embodiment of the present invention, a radiant heater is provided. The heater comprises a heating element configured to radiate heat, and a reflector located proximate to the heating element. The reflector has a generally parabolic shape with the exception of having a generally middle portion of the reflector displaced, while a first edge and a second edge of the reflector remain approximately in positions associated with the generally parabolic shape.

In accordance with another embodiment of the present invention, a radiant heater is provided. The heater comprises means for radiating heat, and means for reflecting heat in a direction. The reflecting means has a generally parabolic shape, with the exception of having a middle portion of the reflecting means displaced, while a first and a second edge of the reflecting means remain approximately in positions associated with the generally parabolic shape.

In accordance with yet another embodiment of the present invention, a method for applying radiant heat is provided. The method comprises the steps of configuring a radiant heat generating device for connection to an electrical power source, displacing a middle portion of a radiant heat reflector configuration from a substantially parabolic shape while leaving a first extent and a second extent of the radiant heat reflector configuration substantially undisplaced, enclosing an electrical power circuit, guarding the radiant heat generating device from physical intrusion, and providing electrical connectivity from the radiant heat generating device to an electrical terminal apparatus configured as a component of the radiant heat applying method.

There have thus been outlined, rather broadly, certain embodiments of the invention, in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
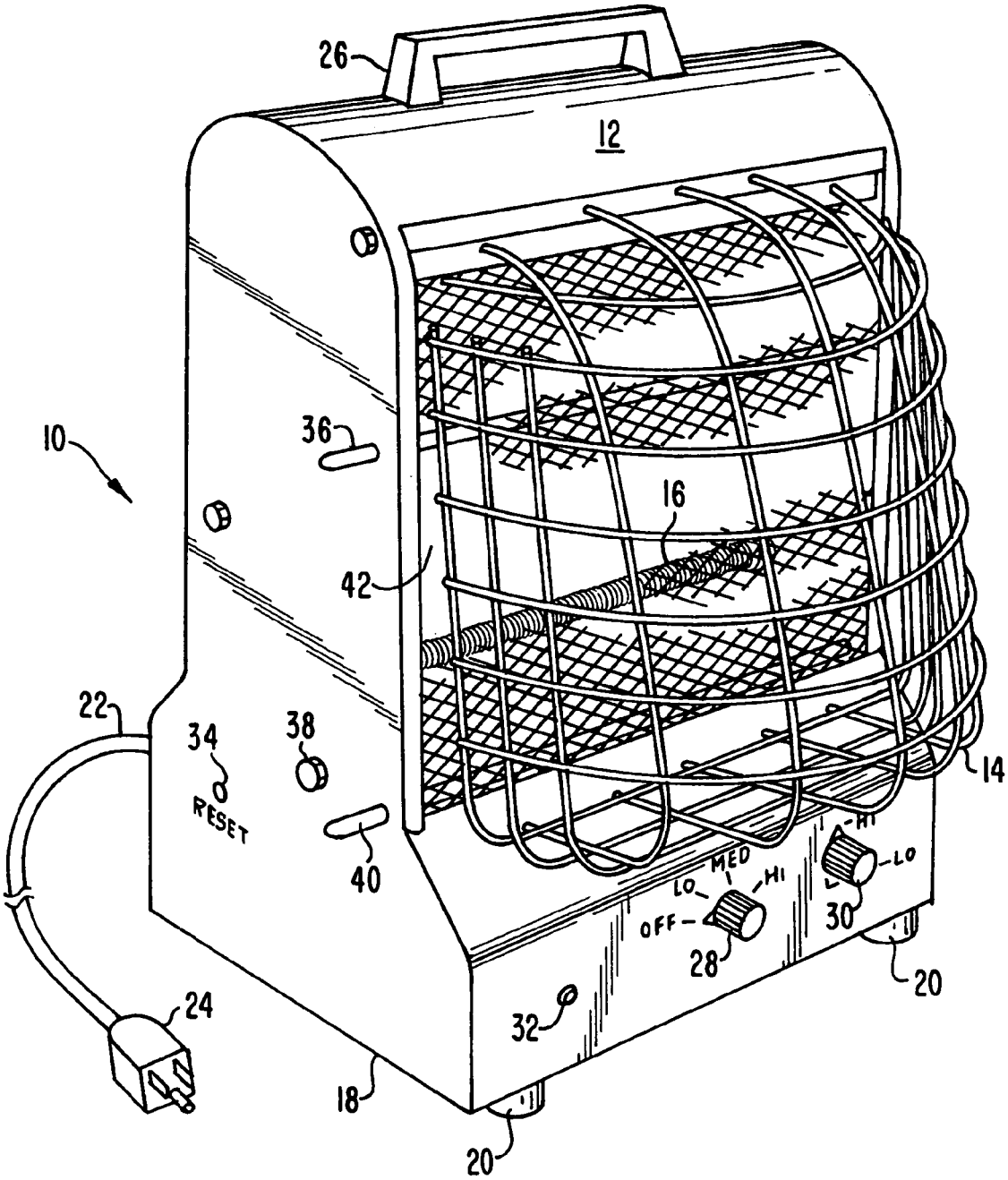
FIG. 1 is a first perspective view illustrating a heater according to an embodiment of the invention.

The invention will now be described with reference to the drawing figures, in which like reference numerals refer to like parts throughout. An embodiment in accordance with the present invention provides a radiant heater with infrared reflectors for one or more heating elements generally configured for broad heat diffusion in a generally forward direction.

FIG. 1 is a perspective view that shows an embodiment in accordance with the present invention. Shown is a heater 10 with a housing 12, and a grille 14 that generally prevents direct access to a heating element 16. FIG. 1 also shows additional features of a heater, such as a base 18, feet 20, an electrical cord 22 with a plug 24, a handle 26, a power switch 28, a tip switch (internal), a thermostat 30, an indicator light 32, and a thermal overload 34. FIG. 1 further shows the fittings 36, 38, and 40 used to attach the defocused reflector 42 to the visible side of the housing 12 and to maintain the broad diffusion capability of the reflector 42.

A housing 12 of the type shown is generally suitable for containing and preventing inadvertent contact with electrical components and for providing a rigid mechanical framework in which heating element 16 and the defocused reflector 42 may be mounted and held in comparatively immovable relationship to the other components therein. A housing 12 may be made of metal, suitable nonmetals, or a combination thereof, and may be formed of one or more pieces by a variety of manufacturing methods such as punching and pressing metal parts, molding plastics, and the like. Component parts may be given corrosion-resistant finishes where appropriate. Parts may be joined to form an integral whole using fastenings such as screws, rivets, and clips, integral attachment fittings such as self-hinges, barbs, and receptacles, and assembly materials and processes such as welds, solders, and glues if needed.

The grille 14 shown is one of a variety of suitable embodiments. Grilles 14 of comparable function may be welded or otherwise bonded from suitable materials, or may be punched and pressed, cast, or formed by other processes suitable to the materials chosen. A typical grille 14 may be mounted substantially permanently to the housing 12, for example with clips, screws, barb fittings, spring tension, and the like.

FIG. 1 shows a heating element 16, one of many common types of heating elements that may be suitable for the instant invention. Suitable types include resistive ribbon, a heating element sold under the trademark CALROD® (a substantialy continuous, commonly metallic sheath surrounding a nickel chromium or similar resistance wire, with thermally conductive, electrically insulating material between; CALROD is a registered tradename of the General Electric Corporation), a resistance wire wound on an insulating core, and a fused-quartz-jacketed heating element, as well as other types. Any heating element type, when applied to the instant invention, may have a generally linear configuration and generally uniform radial distribution of radiant energy about a longitudinal axis. Typical materials for a resistive heating element include nickel-chromium-iron alloys.

A base 18 is shown in FIG. 1. The base 18 shown separates potentially warm regions of the housing 12 from a surface on which it would otherwise rest, and is one of various embodiments capable of performing this function. While many portable heaters incorporating the inventive apparatus may have bases, heaters intended for mounting to a wall or overhead support, for example, may not include bases on which they can stand. Still other heaters may have separate bases or stands to which they may be permanently, adjustably, or removably attached.

Feet 20 are shown beneath the base 18. Where used, feet 20 may be of any suitable shape, and may be variously insulating, skid-resistant, and/or made from thermosetting (non-melting) material as appropriate. The use of feet 20 may in some embodiments enhance airflow beneath the base 18 bottom surface. This is addressed further under FIG. 5, below. The number of feet 20 used may be as few as one for some embodiments, while other embodiments may use any number, although it may be anticipated that many embodiments use three or four feet 20.

A flexible power cord 22 terminated in a 3-wire plug 24 is shown. A typical cord 22 may also be terminated in a 2-wire plug 24. A flexible or semirigid cord 22, substantially permanently attached to the housing 12, may provide utility to a space heater without imposing a requirement on a user to manage a separate electrical wiring arrangement. Notwithstanding the desirability of a built-in cord 22 for some applications, a cord 22 that can plug into a socket on the heater may also be used. Similarly, for other applications, electrical contacts at fixed locations such as terminals or free-hanging wires within the housing 12 may be provided so that a user can make electrical connections, which connections may use conduit, premises wiring materials, electrical cord, or the like. In such applications, cover plates may allow electrical connections made by the user to be guarded against intrusion or disruption.

A handle 26 is an optional feature of a portable heating device 10. If present, a handle 26 may, for example, be insulating and/or made from thermosetting (non-melting) material. A handle 26 may instead be predominantly metallic, where a metallic handle may in some embodiments be attached to the housing 12 using insulating standoffs or clips. A handle 26 may also be an integral part of the housing 12, for example.

A power switch 28 is shown in FIG. 1. This may be a basic on-off switch 28 or may additionally function to allow selection between multiple power settings. For example, a three-position switch 28 can have high and low output positions and an off position, while other switch 28 styles may allow one or more intermediate output settings as well. For some embodiments, there may be no power switch 28, such as for permanently-mounted heaters 10 operated from fixed remote controls.

The use of multiple output settings may include two or more output levels and multiple output functions. The number of output power levels available may be determined by details of implementation. For example, a heater with a single element 16 and an on-off switch 28 may have a single output level. A heater with two unequal heating elements 16 can power the lower alone, the higher alone, or both in parallel to get three output levels, which requires a four-position switch 28 (off-low-medium-high) and appropriate internal wiring. Alternate embodiments may, for example, omit one of the three "on" positions to provide a two-level heater, may reduce power by configuring elements in series rather than in parallel, or may remove power to elements in series (to increase) or parallel (to reduce) power output.

The embodiment shown in FIG. 1 combines forced-air and radiant heating by adding a fan internal to the heater 10, which fan runs at some switch 28 settings in conjunction with heating element 16 and with a second heating element substantially concealed behind the visible reflector 42. The second heating element is positioned between a second reflector (not shown) and the visible reflector 42, which two reflectors create an air slot through which fan-forced air passes at some switch 28 settings. Inlet air in support of this operating mode is admitted in the embodiment of FIG. 1 through louvers in the base and rear of the enclosure 12, as discussed below under FIG. 5.

FIG. 1 further shows an optional built-in thermostat 30. A thermostat 30 allows a self-contained portable heater 10 to be self-regulating, switching itself on when an ambient temperature drops below a minimum and switching itself off when the ambient temperature exceeds a maximum. A thermostat 30 may have hysteresis to permit power cycling to occur at moderate intervals. Since the heater 10 itself may need to cool after cycling off before it can sense the ambient temperature, a thermostat 30 may need greater hysteresis than would be required if, as in an alternate embodiment, the thermostat 30 were installed in the heated space but remote from the heater 10.

FIG. 1 further illustrates an optional indicator light 32. An indicator light 32 can be configured to indicate when power is applied to the heater 10 or when heat is being emitted by the heater 10. Alternative embodiments could indicate both of those functions, or could have contact closures to permit remote detection of the mode of the heater 10.

FIG. 1 further shows a thermal overload circuit interrupter 34. A thermal overload interrupter 34 may be used to automatically shut down the heater 10 in event of an overtemperature or overcurrent event. The externally visible element of the thermal overload interruptor 34 in FIG. 1 is a reset button. Thermal overload interrupters 32 may be resettable or nonresettable. Resettable types may be reset using, for example, a push or a pull element, a toggle, or an automatic cycling device with no actuator. Fuses may be used as interrupters.

A tip switch (entirely enclosed within the housing in the embodiment shown and thus not visible in the figures shown) is a device to immediately remove power from a heater 10 if the heater 10 is tilted outside an allowed range or is knocked over. In some embodiments a tip switch may also detect if a heater is picked up. Fixedly mounted heaters may not use a tip switch. Some styles of tip switch may be integral with the power switch 28, the thermostat 39, or the overload circuit interrupter 34.

Figure 2:
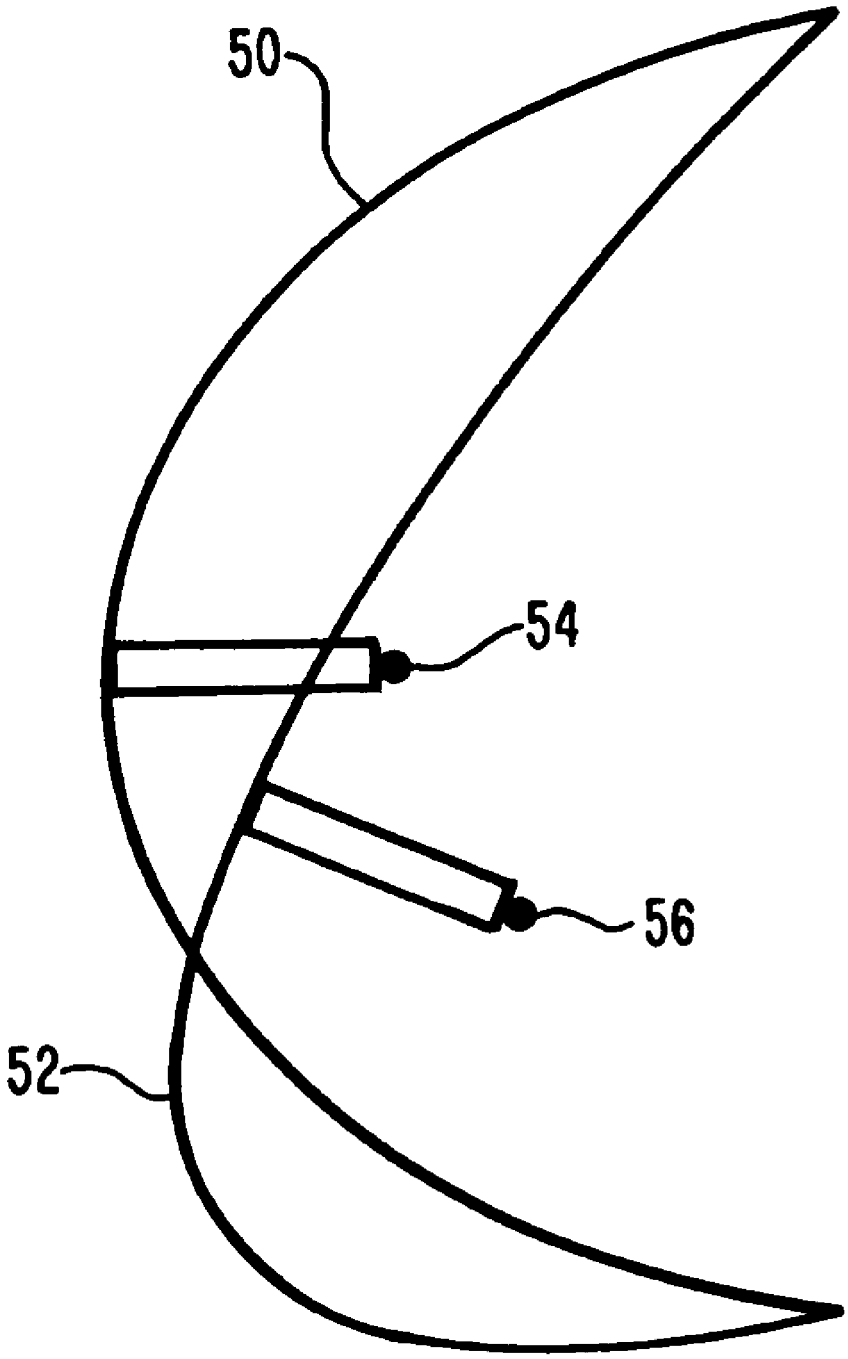
FIG. 2 is a section view comparing the reflector shape profiles for a generally parabolic reflector and the reflector according to an embodiment of the invention.

FIG. 2 is a section view that shows both a substantially parabolic reflector configuration 50 that approximates a shape known as a parabolic cylinder, and the generally nonparabolic reflector profile 52 of the inventive apparatus. It may be observed that the bulk of the radiant energy reflected by a generally parabolic shape 50 of the type shown, with a heater element 54 located proximal to its focus, travels along a roughly parallel path. The defocused reflector shape 52 of the inventive apparatus, by contrast, may have its heater element 56 located away from any focal point of the reflector 52. This may result in increased scattering of the reflected heat, so that there is a less intense, more distributed zone of highest heat proximal to the grille 14 of FIG. 1.

Formation of the nonparabolic, defocused reflector 52 of the inventive apparatus may be realized by bending a self-supporting parabolic reflector 50 into the generally nonparabolic profile shown and stabilizing the defocused reflector 52 so formed using deflection fittings such as screws, rivets, clips, tabs, or brackets. The defocused reflector 52 profile of FIG. 2 may also be formed by pressing the reflector material directly into the preferred shape using a die, fitting the material into a groove, slot, guide, series of retention fittings, or the like that are integral with or retained by the housing 12 of FIG. 1, curving the reflector material around a forming profile, or otherwise shaping the reflector material to achieve the properties herein described.

Figure 3:
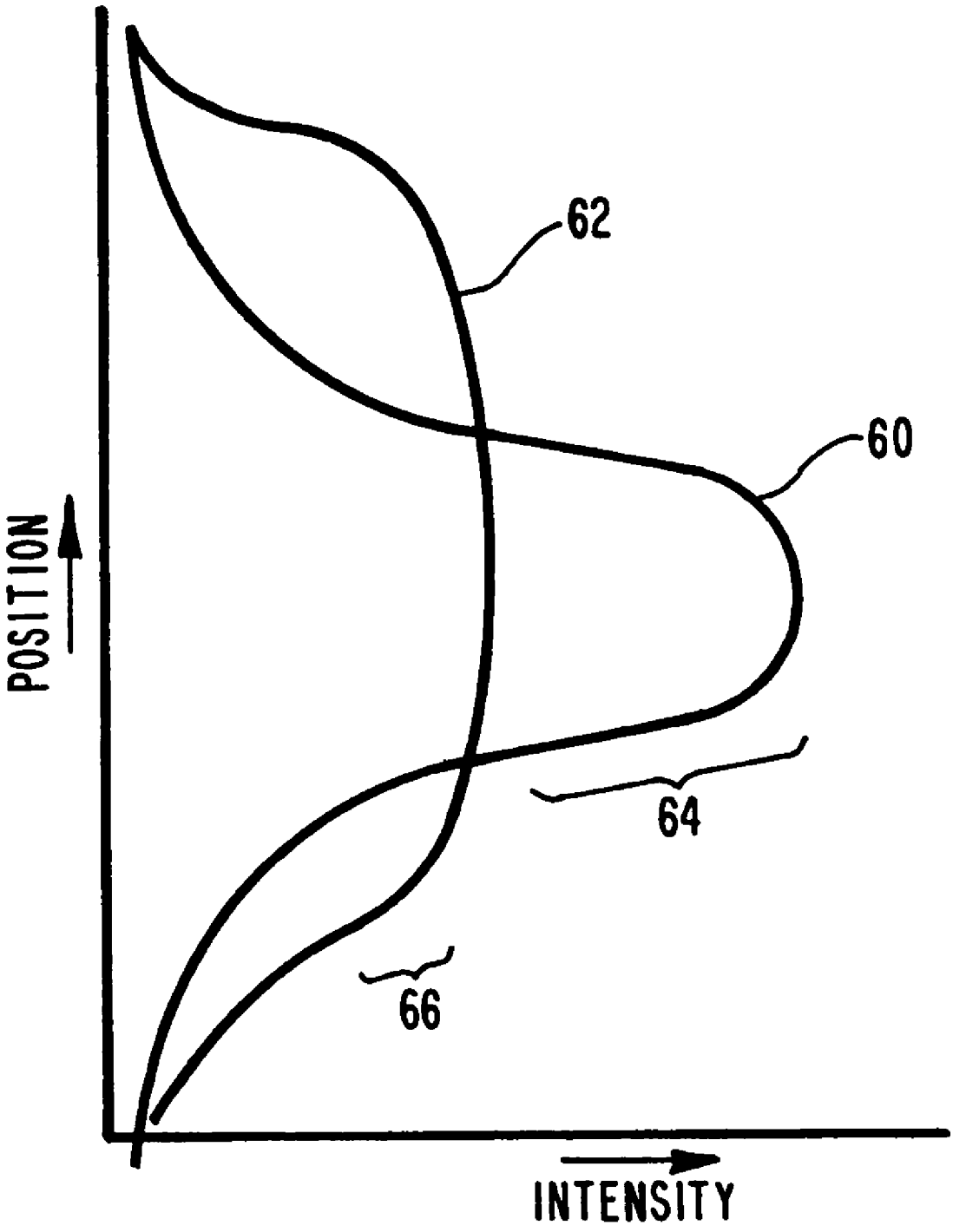
FIG. 3 is a graph showing the relative heat profiles of a heater having a generally parabolic reflector and a heater according to an embodiment of the invention.

FIG. 3 is a graph comparing the heat distribution intensities of a parabolic reflector and the inventive reflector. Curve 60 represents the heat distribution characteristic of a parabolic reflector, while curve 62 represents the heat distribution characteristic of an embodiment of a reflector in accordance with the present invention. Evident in the graph is that the peak energy in the region of highest radiative intensity for the paraboloid reflector may be appreciably greater than the corresponding region for the inventive apparatus.

Figure 4:
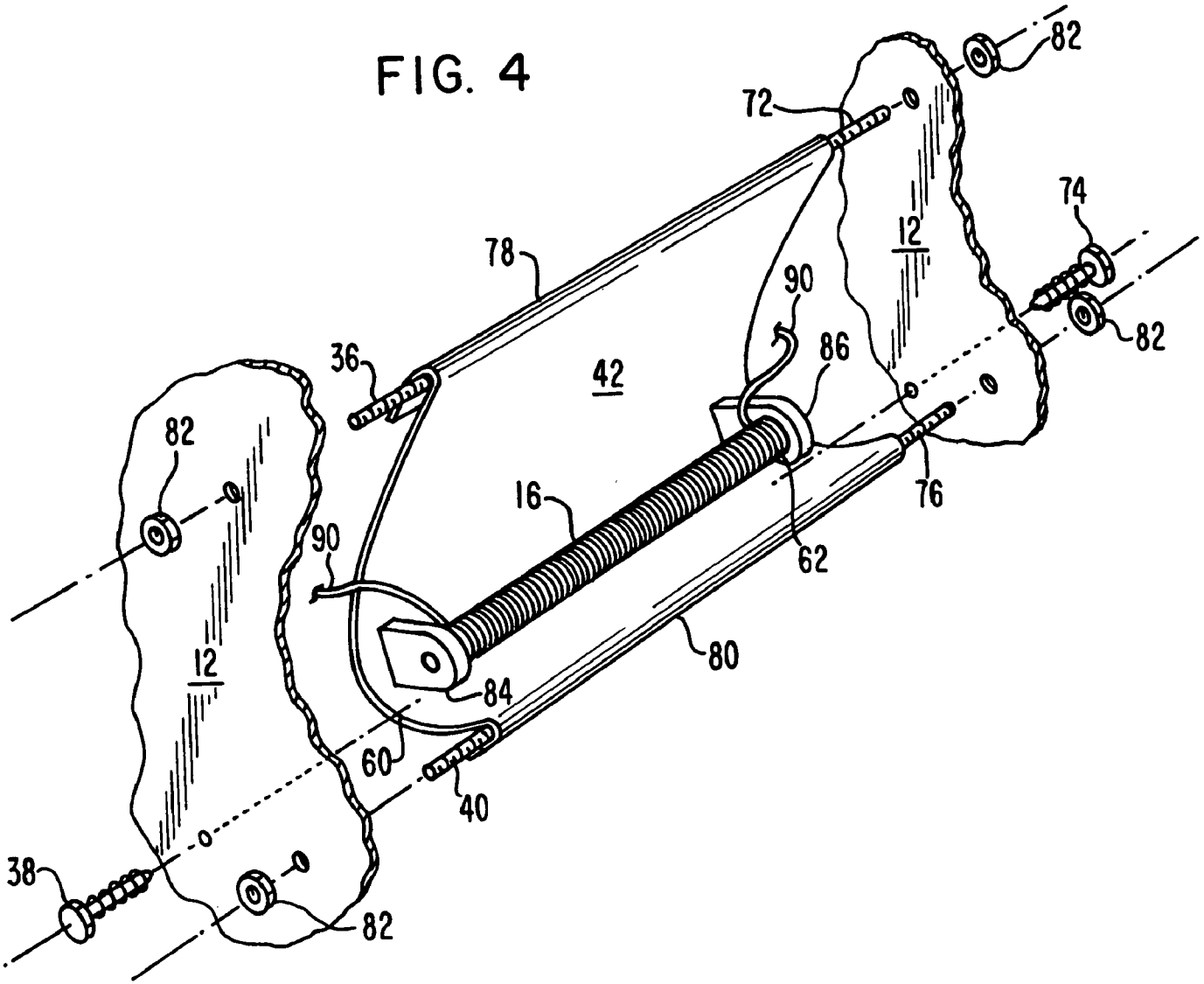
FIG. 4 is an isometric cutaway view of a heater reflector and associated elements according to an embodiment of the invention.

FIG. 4 is a view of a defocused reflector 42 with first, second, third, and fourth attachment apparatuses 36, 72, 40, and 76, where each of the mounting apparatuses 36, 72, 40, and 76 supports a corner of the defocused reflector 42. The defocused reflector 42 further employs first and second deflection fittings 38 and 74 that maintain the attached reflector 42 in a defocused orientation. The first and second attachment apparatuses 36 and 72 may in some embodiments take the form of a single rod around which an upper edge 78 of the reflector 42 is formed. In some embodiments, a bottom edge 80 of the reflector 42 may likewise be formed around a rod serving as the third and fourth attachment apparatuses 40 and 76. Such rods may penetrate the housing 12 and be attached thereto by fastenings 82, or may be attached by other suitable methods. In other embodiments, the first, second, third, and fourth attachment apparatuses 36, 72, 40, and 76 may be realized in the form of tabs or equivalent fittings integral with or attached to the reflector 42. Such tabs may be inserted into slots, screwed or riveted, or welded to the housing 12, or may be integral with the housing 12.

Deflection fittings 38 and 74 are shown in FIG. 4. The fittings assist in establishing the shape of the reflector 42 and in stabilizing the curve thereof. Such fittings may be fastening hardware of various styles, such as screws, as shown in FIG. 4, or rivets, or may, for example, be established as tabs attached to or formed out of the housing 12 material. In some embodiments, fastening hardware may be secured to an inner housing wall and thus not visible outside the housing 12.

FIG. 4 further shows mounting brackets 84 and 86 that carry a heating element 16. As shown, the reflector 42 provides support for the brackets 84 and 86. This arrangement couples the shape of the reflector 42 to the position of the heating element 16. Other arrangements, such as one in which the heating element brackets are attached to the housing 12, may permit the reflector 42 shape and heating element 16 position to be varied independently. Electrical wires 90 provide power to the heating element 16.

Alternative reflector 16 shapes may also provide effective defocusing, such as a vee shape or a "washboard" shape in place of the approximate paraboloid of a focused reflector. Similarly, placing the heating element 16 away from any functional axis of focus of a reflector of any configuration may further reduce and distribute heat concentration.

Figure 5:
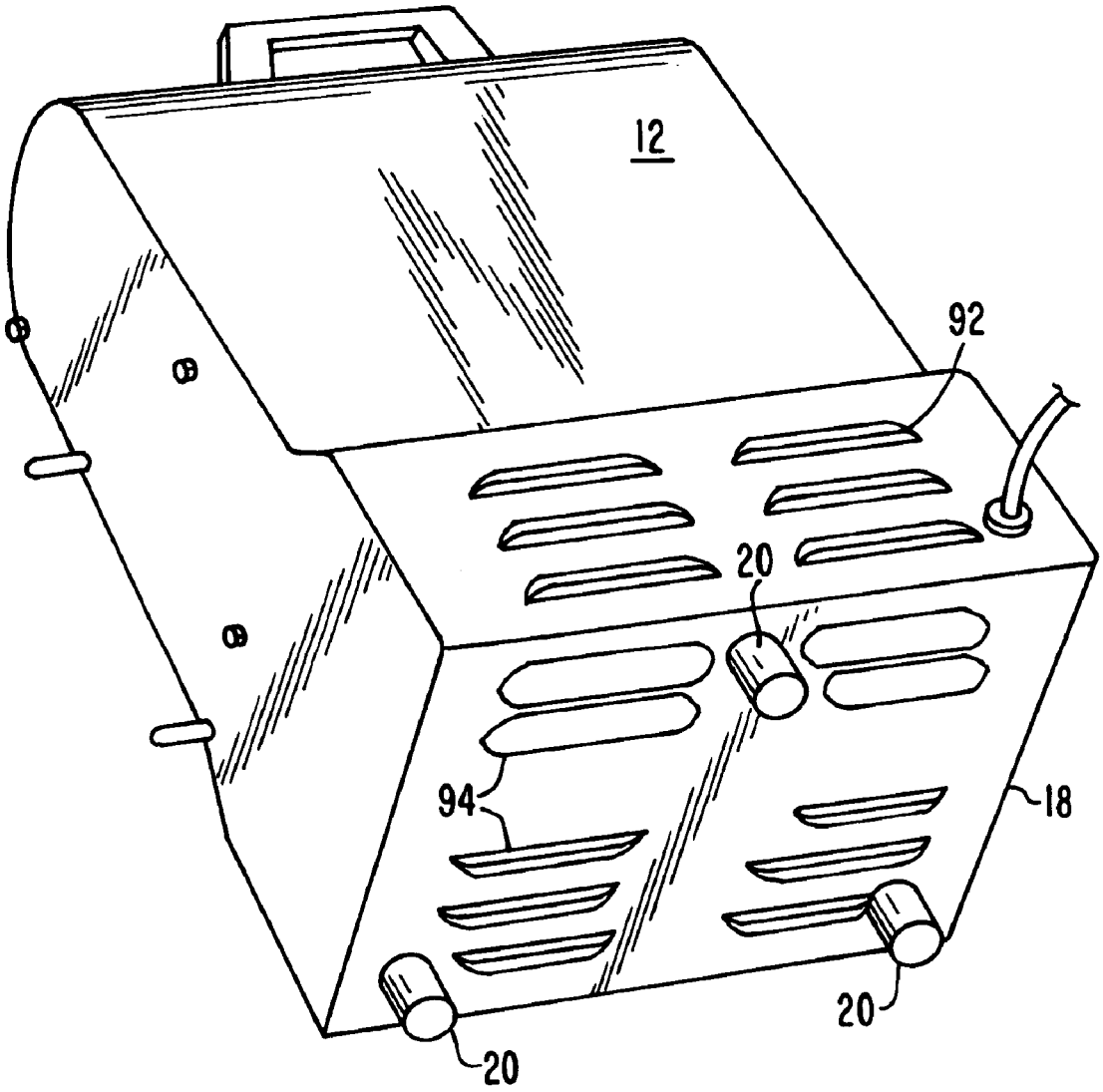
FIG. 5 is a second perspective view illustrating the louvers and feet of an embodiment of the invention.

FIG. 5 shows an oblique view from below. Here, the feet 20 may be seen to be able to position the base 18 off a floor. Since air flow into the heater 10 by back louvers 92 and bottom louvers 94 can promote the forced-air modes of operation described above for the embodiment shown, the use of feet 20 as indicated may be desirable. Alternative embodiments can provide for air flow into the heater 10 without bottom louvers 94, in which embodiments inclusion of feet 20 may nonetheless be desirable.

Although an example of the defocused radiative heater 10 is shown with insulating feet 20 to rest on a floor, it will be appreciated that the heater 10 can be used attached to a vertical surface such as a wall or hung from a ceiling using a suitable support mount. Also, although the heater 10 is useful for space heating in spaces intended for human occupancy, it can also be used both for warming other habitable spaces, such as barns and kennels, and for performing such functions as maintaining air temperatures above freezing in manufacturing and storage facilities, machinery rooms, and the like.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to that fall within the scope of the invention.

What is claimed is:

1. A radiant heater, comprising:

a heating element configured to radiate heat;

a first reflector support, a second reflector support, a third reflector support, and a fourth reflector support; and a reflector located proximate to said heating element, said reflector having a shape that is generally parabolic in cross-section with the exception of having a generally middle portion of said reflector displaced, while a first edge and a second edge of said reflector remain approximately in positions associated with the generally parabolic cross-section, wherein said first and second reflector supports configured as a pair comprise a rod, and said third and fourth reflector supports configured as a pair comprise a rod, around both of which rods said reflector passes in part.

2. The radiant heater of claim 1, further comprising:

a housing enclosing said at least one heating element and said reflector at least in part, wherein said at least one heating element is generally linear in configuration; and a deflection fitting so displacing said middle portion of said reflector as to render diffuse a pattern of heat distribution by said radiant heater.

3. The radiant heater of claim 2, wherein a reflector confirmation established by said reflector with said first, second, third, and fourth reflector supports and said deflection fitting establishes a limit of radiation focusing sharpness.

4. The radiant heater of claim 2, wherein said deflection fitting comprises a fastener that positions said reflector with respect to said housing.

5. The radiant heater of claim 2, wherein said deflection fitting comprises a protrusion, wherein said protrusion is affixed to or attached to said housing that positions said reflector with respect to said housing.

6. The radiant heater of claim 2, wherein a multiplicity of deflection fittings position said reflector.

7. The radiant heater of claim 2, further comprising an electrical power connection to said at least one heating element.

8. The radiant heater of claim 2, further comprising a protective grille serving as a barrier over said at least one heating element.

9. The radiant heater of claim 2, wherein said at least one heating element is a resistive wire spirally wrapped around an insulating core, a resistive ribbon, a resistive element with a fused quartz jacket, or a substantially continuous metallic sheath surrounding a resistance wire, with thermally conductive, electrically insulating material between.

10. The radiant heater of claim 7, wherein said electrical power connection to said at least one heating element comprises one of an electrical cord, an electrical cord terminated in a plug, an electrical connector affixed to said housing, a set of electrical contacts affixed to said at least one radiant heater, and wires.

11. The radiant heater of claim 2, further comprising at least one of a base, at least one foot, and a handle.

12. The radiant heater of claim 7, wherein said electrical power connection further comprises one of a thermal circuit interrupter, a circuit breaker, and a fuse.

* * * * *